US009185978B1

(12) United States Patent
Chen et al.

(10) Patent No.: US 9,185,978 B1
(45) Date of Patent: Nov. 17, 2015

(54) DRAWER HANDLE WITH RELEASABLE PROTECTIVE MEMBER

(71) Applicants: Kung-Cheng Chen, Taichung (TW); Lung-Chuan Huang, Taichung (TW)

(72) Inventors: Kung-Cheng Chen, Taichung (TW); Lung-Chuan Huang, Taichung (TW)

(73) Assignee: E-MAKE CO., LTD., Taichung (TW)

( * ) Notice: Subject to any disclaimer, the term of this patent is extended or adjusted under 35 U.S.C. 154(b) by 0 days.

(21) Appl. No.: 14/552,911

(22) Filed: Nov. 25, 2014

(51) Int. Cl.
*A47B 88/00* (2006.01)
*A47B 95/02* (2006.01)
*A47B 88/04* (2006.01)

(52) U.S. Cl.
CPC ..... *A47B 95/02* (2013.01); *A47B 88/04* (2013.01); *A47B 2095/024* (2013.01); *A47B 2095/025* (2013.01)

(58) Field of Classification Search
CPC ..... A47B 2095/024; A47B 2095/025; A47B 88/0044
USPC ..... 312/234, 234.1, 234.3, 234.4, 348.4, 312/348.6, 234.5; 40/325, 661.3; 16/415, 16/441, 422, DIG. 24
See application file for complete search history.

(56) References Cited

U.S. PATENT DOCUMENTS

| | | | | | |
|---|---|---|---|---|---|
| 1,774,229 | A * | 8/1930 | Day | 40/325 |
| 1,838,369 | A * | 12/1931 | Dawson | 40/325 |
| 2,758,748 | A * | 8/1956 | Konefes | 220/655 |
| 3,238,656 | A * | 3/1966 | Kanzelberger | 40/325 |
| 4,096,603 | A * | 6/1978 | Klaus | 16/416 |
| 5,730,511 | A * | 3/1998 | Doan et al. | 312/234.4 |
| 6,920,820 | B2 * | 7/2005 | Meggison et al. | 99/422 |
| 7,540,576 | B1 * | 6/2009 | Ross | 312/348.4 |
| 2009/0195134 | A1 * | 8/2009 | Liu et al. | 312/348.6 |

FOREIGN PATENT DOCUMENTS

| | | | |
|---|---|---|---|
| CH | 635992 | * | 5/1983 |
| DE | 3219926 | * | 1/1983 |
| WO | 2004017796 | * | 3/2004 |
| WO | 2004073454 | * | 9/2004 |

OTHER PUBLICATIONS

CN 203684837; abstract and figure; pub date Jul. 2, 2014.*
DE 202006005090; abstract and figure; pub date Jul. 27, 2006.*

* cited by examiner

*Primary Examiner* — Janet M Wilkens

(57) ABSTRACT

A drawer handle is provided with two side plates; a front plate including an upper joining part, the joining part having an elevation greater than that of either side plate; a rear plate; a bottom; a handle secured to the joining part; and a protective member releasably mounted on the handle and including a covering element on a front surface for covering a portion of the handle, and a recessed label portion on a front surface of the covering element, the recessed label portion having an area slightly smaller than that of the front surface of the protective member so that a label is configured to affix to the recessed label portion.

3 Claims, 9 Drawing Sheets

DRAWER HANDLE WITH RELEASABLE PROTECTIVE MEMBER

BACKGROUND OF THE INVENTION

1. Field of the Invention

The invention relates to drawers and more particularly to a drawer handle including a protective member having a label, the protective member being releasably secured to the handle.

2. Description of Related Art

A conventional tool chest or cabinet is provided with at least one drawer which has a handle made of, for example, metal. Static electricity may build up on the handle especially in winter or dry environment. A person may be shocked by static discharge when the hand contacts the handle. This is a feeling of discomfort.

Typically, a label is affixed to the surface of the cabinet. On the label, information about the cabinet is written or printed. However, the label may be worn or become blurry after a period time of use.

Thus, the need for improvement still exists.

SUMMARY OF THE INVENTION

It is therefore one object of the invention to provide a drawer comprising two side plates; a front plate including an upper joining part, the joining part having an elevation greater than that of either side plate; a rear plate; a bottom; a handle secured to the joining part; and a protective member releasably mounted on the handle and including a covering element on a front surface for covering a portion of the handle, and a recessed label portion on a front surface of the covering element, the recessed label portion having an area slightly smaller than that of the front surface of the protective member so that a label is configured to affix to the recessed label portion.

The above and other objects, features and advantages of the invention will become apparent from the following detailed description taken with the accompanying drawings.

DETAILED DESCRIPTION OF THE INVENTION

Figure 1:
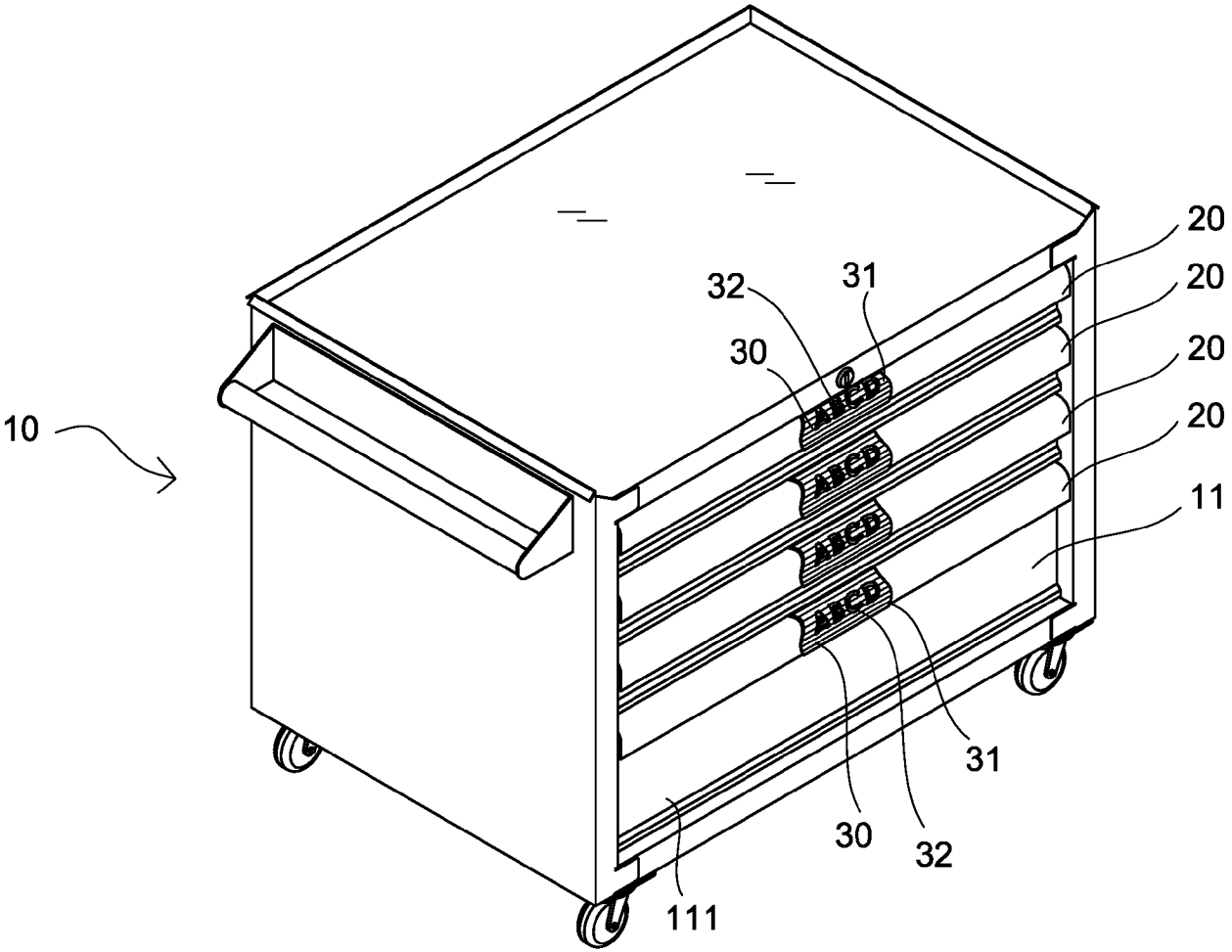
FIG. 1 is a perspective view of a cabinet having a plurality of drawers arranged vertically, each drawer having a protective member releasably secured to a handle according to the invention.
Figure 2:
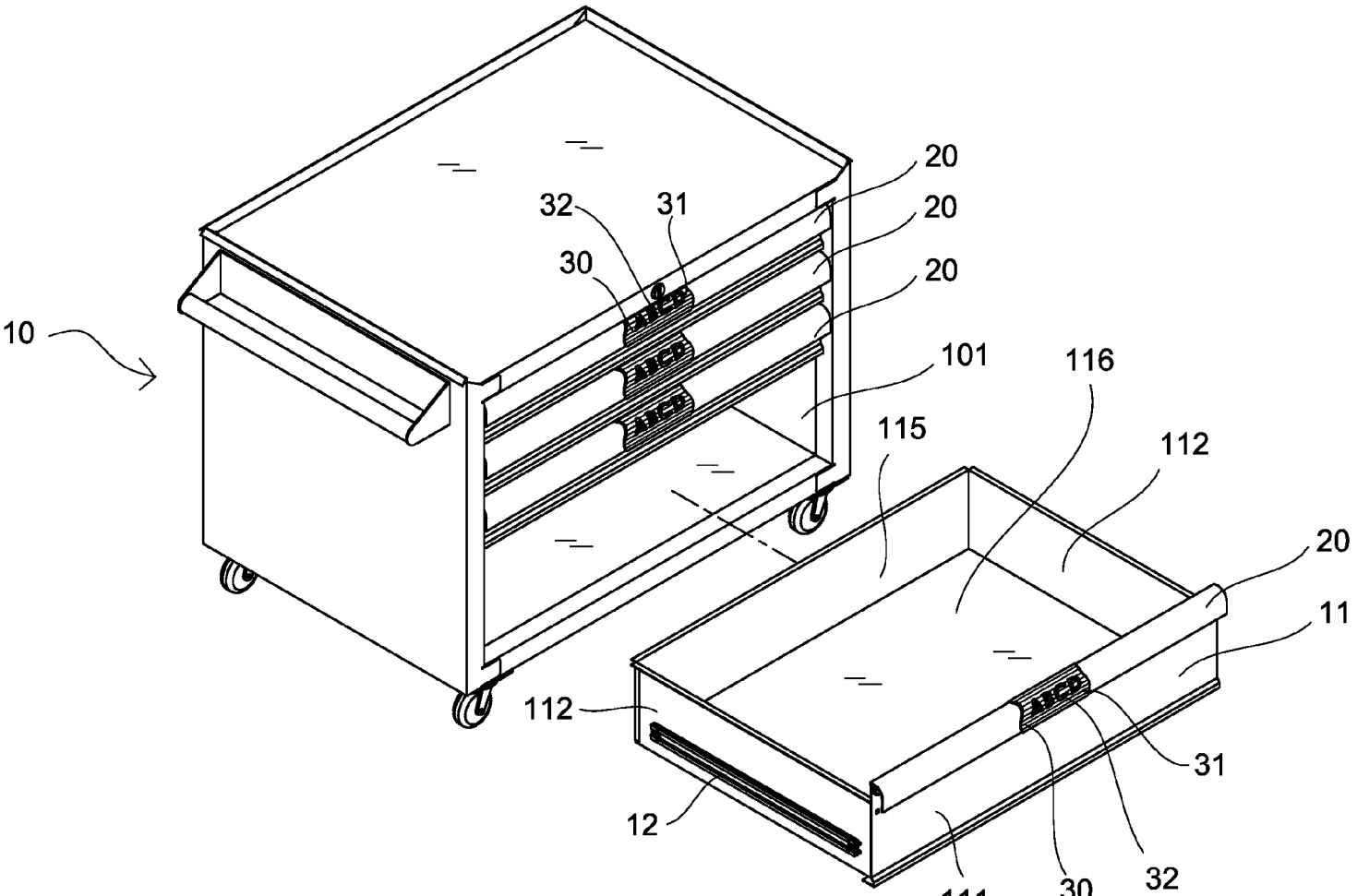
FIG. 2 is a view similar to FIG. 1 with one drawer completely pulled out of the cabinet.
Figure 3:
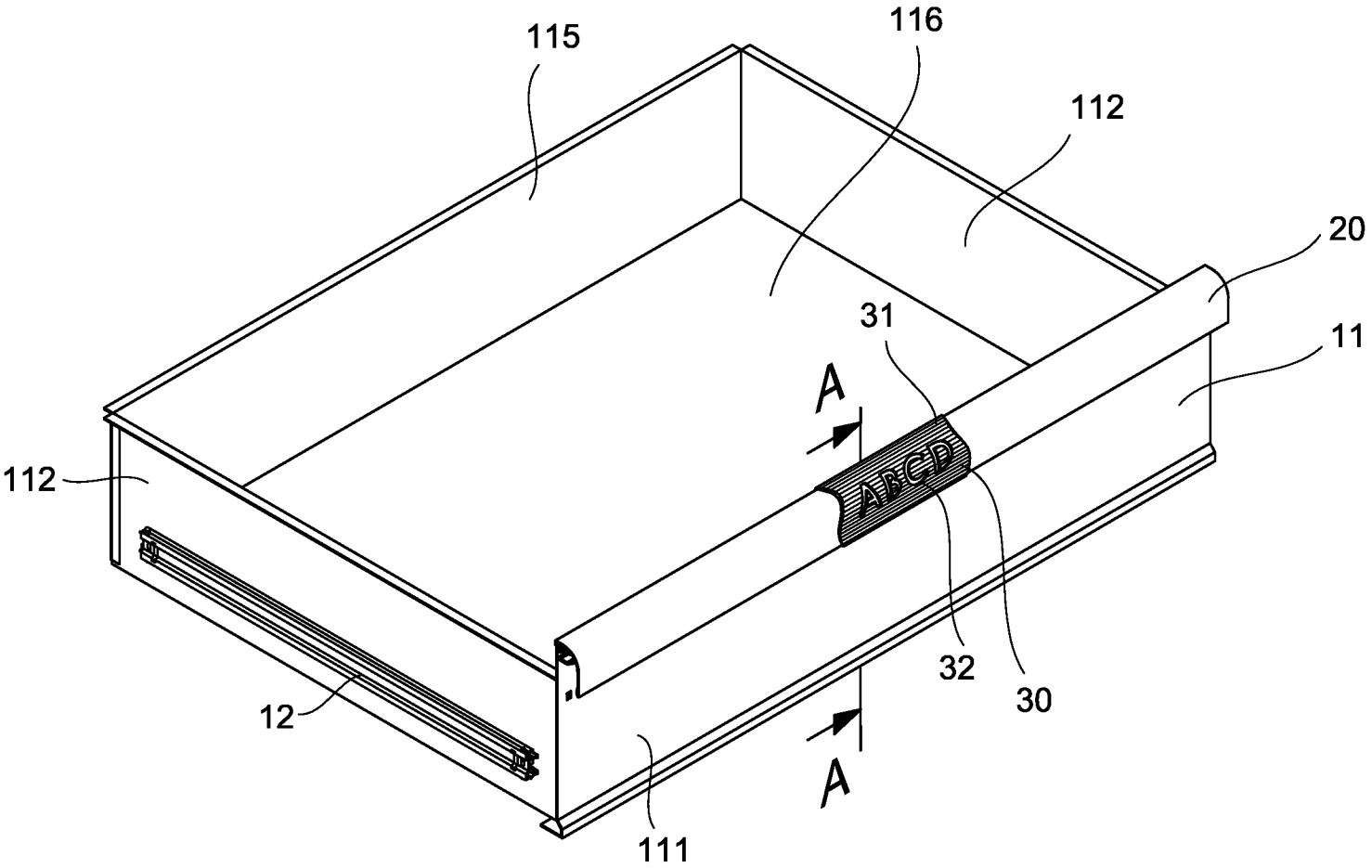
FIG. 3 is a perspective view of the pulled out drawer of FIG. 2.
Figure 4:
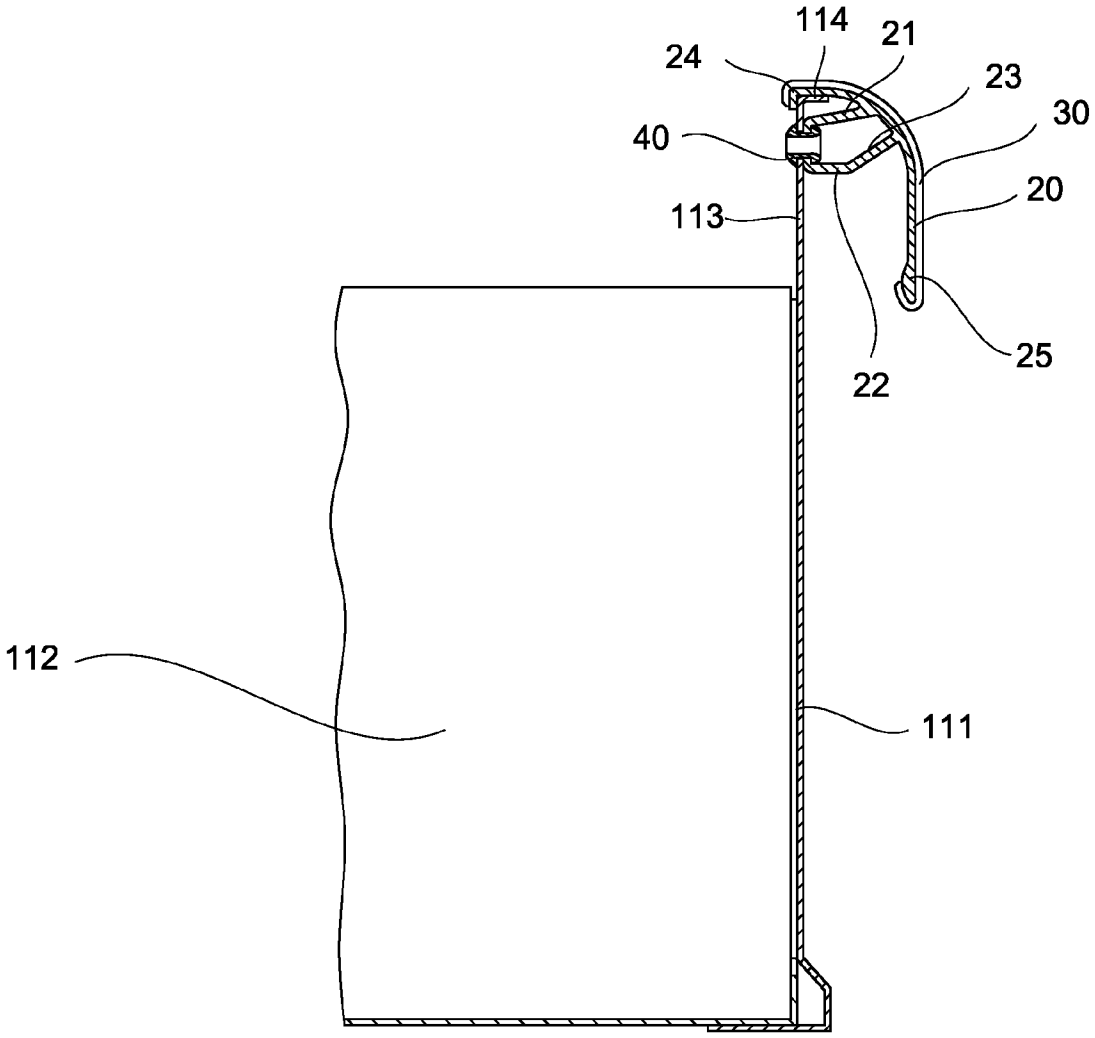
FIG. 4 is a sectional view taken along line A-A of FIG. 3.
Figure 5:
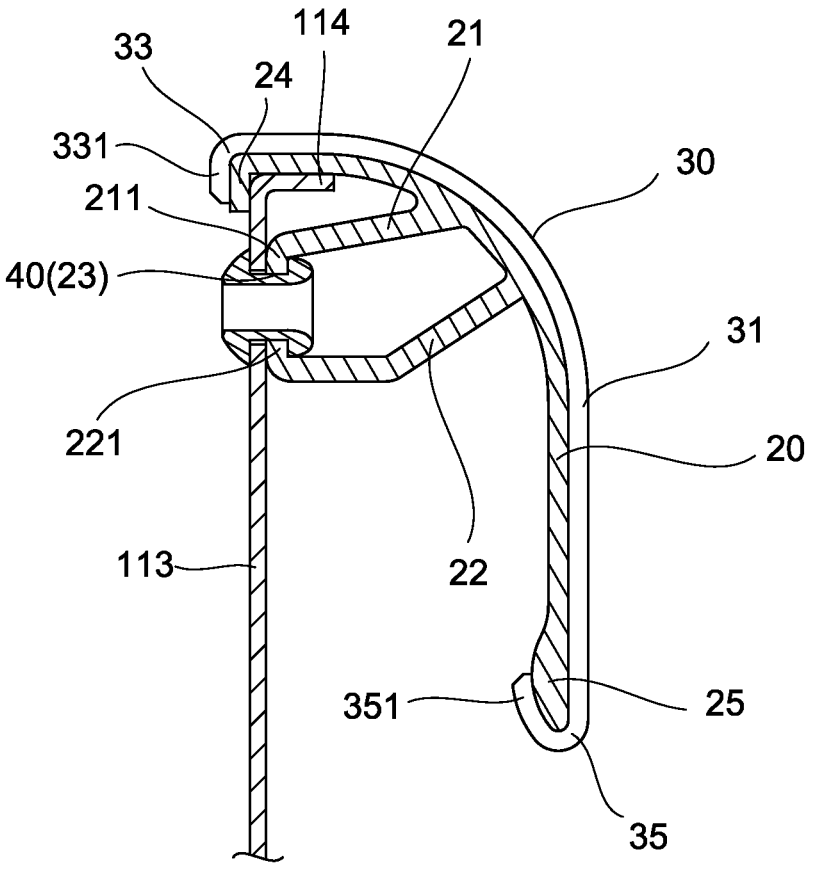
FIG. 5 is an enlarged view of the handle and adjacent component shown in FIG. 4.
Figure 6:
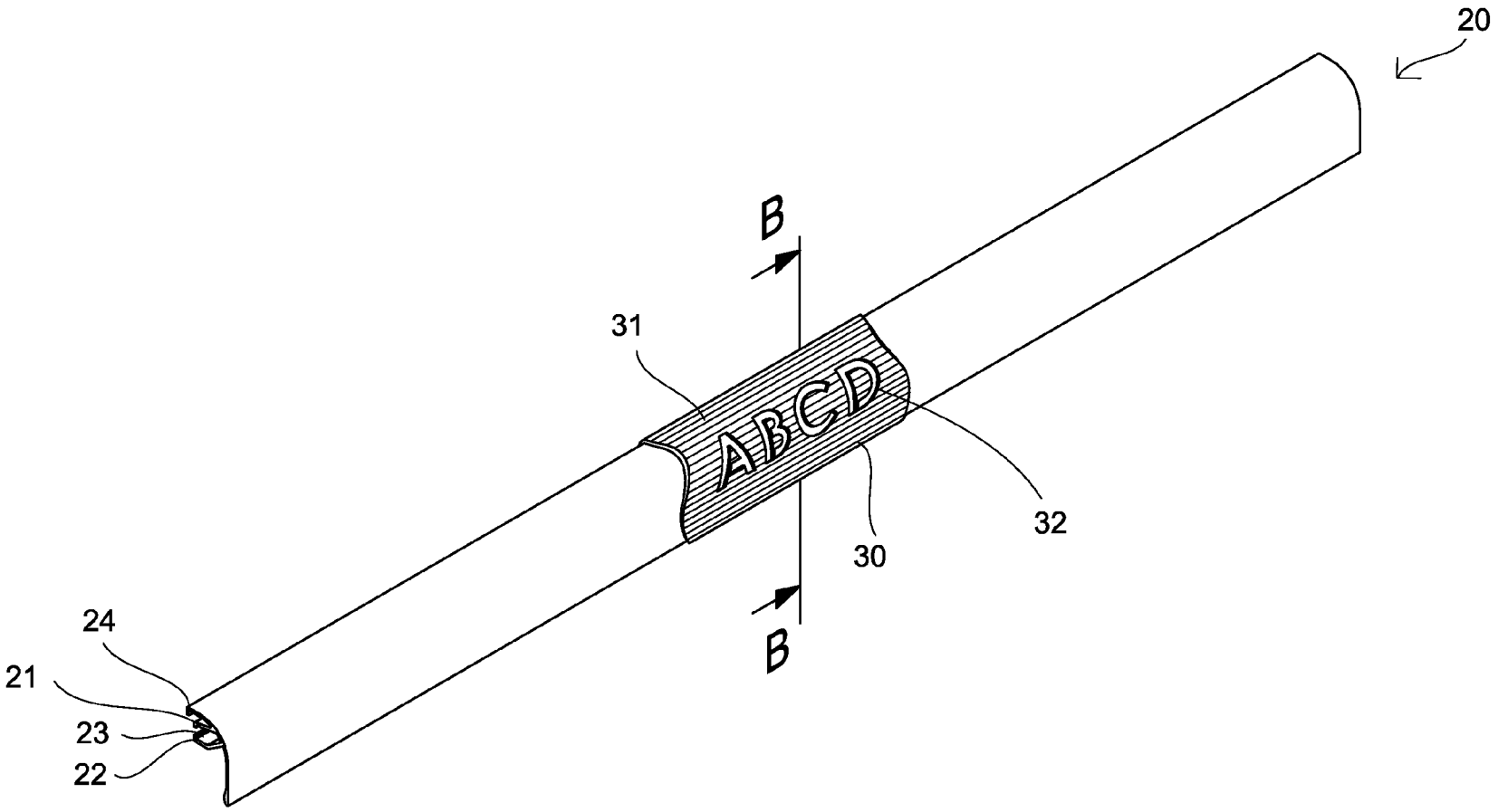
FIG. 6 is a perspective view of the detached handle.
Figure 7:
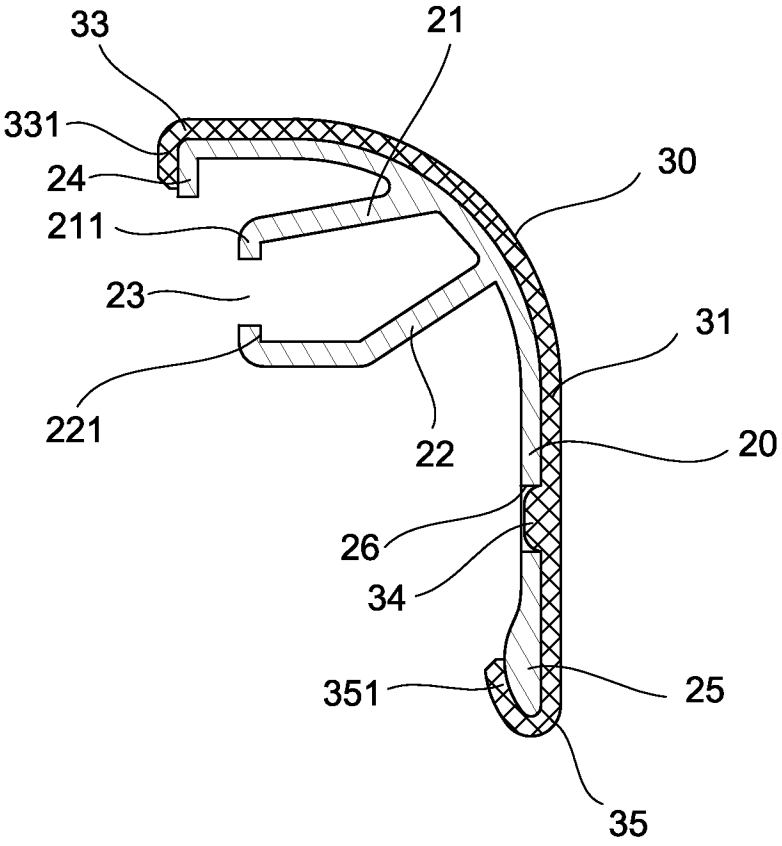
FIG. 7 is a sectional view taken along line B-B of FIG. 6.
Figure 8:
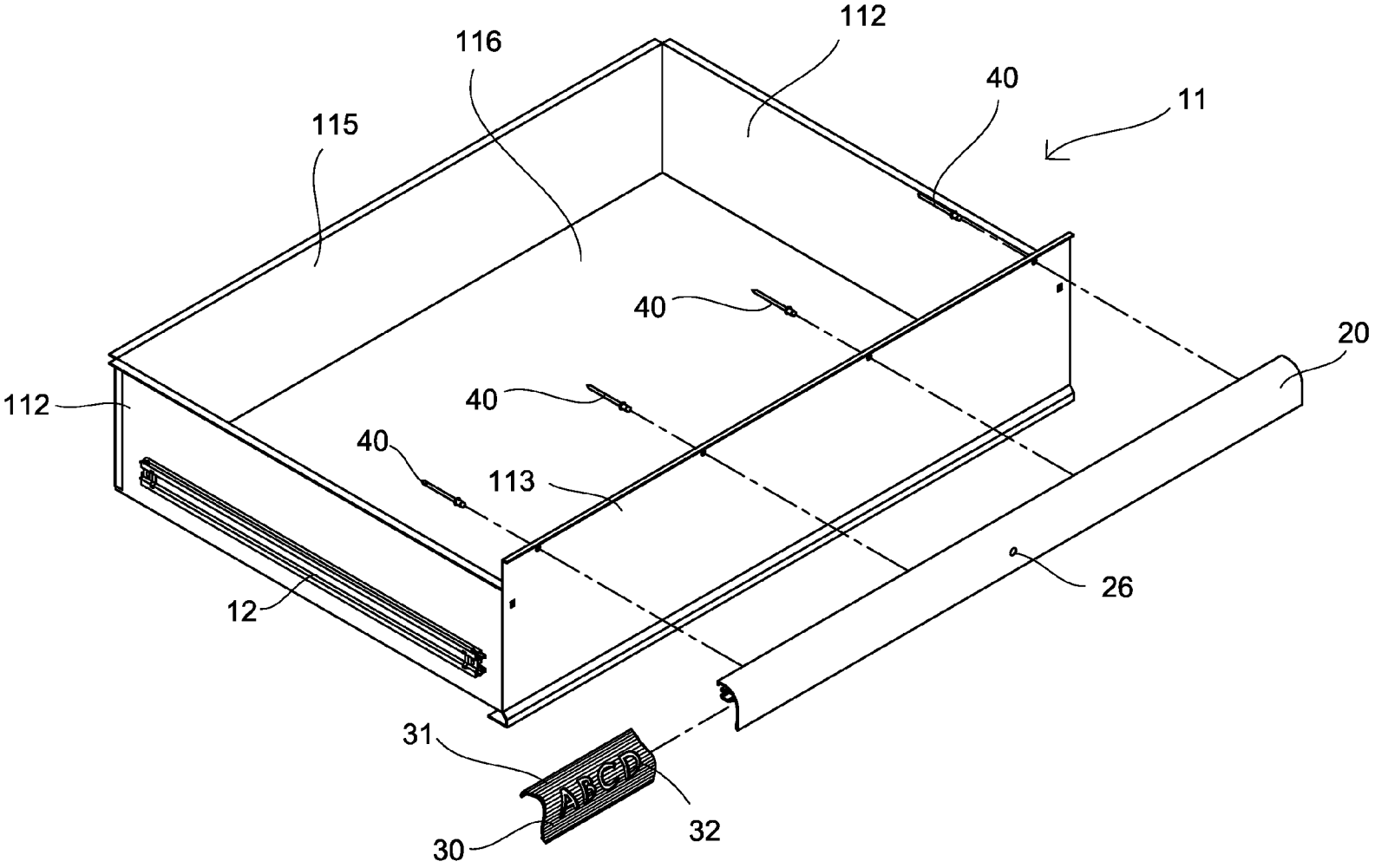
FIG. 8 is a perspective view of the drawer, the handle, and the label member to be assembled.
Figure 9:
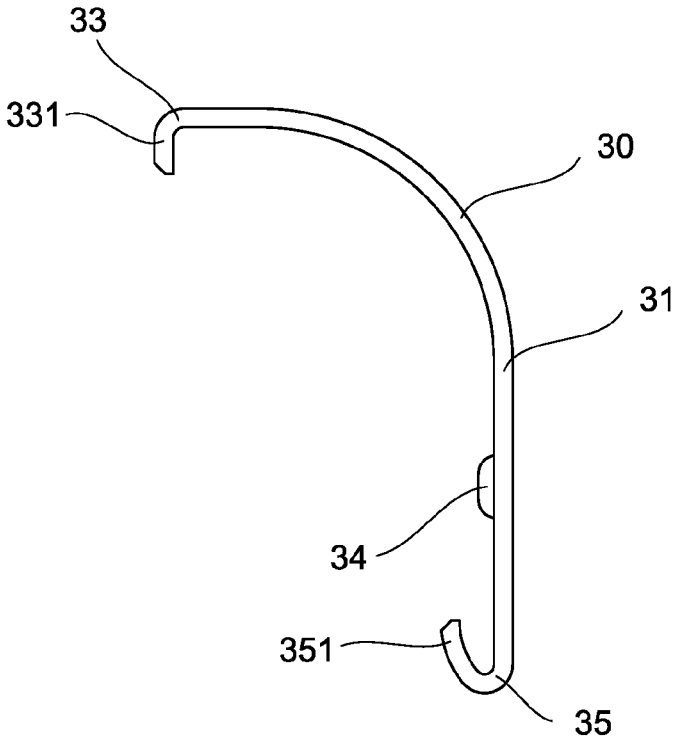
FIG. 9 is a side elevation of the label member.
Figure 10:
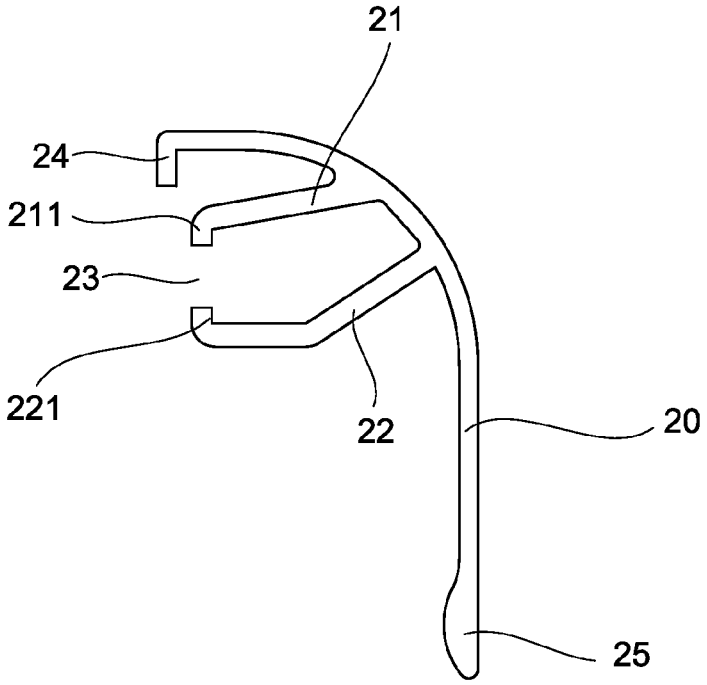
FIG. 10 is a side elevation of the handle.

Referring to FIGS. 1 to 10, the invention comprises a cabinet 10 including a plurality of drawers 11 each having a handle 20. The drawer 11 includes a front plate 111, two side plates 112, a rear plate 115, and a bottom 116. An upper portion of the front plate 111 having an elevation greater than the side plate 112 is served as a joining part 113. A ledge 114 is formed on a top of the joining part 113. A slide assembly 12 is provided on an outer surface of either side plate 112 for slidably pulling or pushing the drawer 11 relative to the cabinet 10.

The elongated handle 20 is provided on the joining part 113 and includes a hole 26 on a center facing forward, a first stop 24 extending downward from a top rear edge, a second stop 25 formed on a bottom end, a first fastening portion 21 formed on a rear surface and having a first fastening member 211 extending downward from an open end and contacting the joining part 113, a second fastening portion 22 under the first fastening portion 21 formed on the rear surface, the second fastening portion 22 having a second fastening member 221 extending upward from an open end and contacting the joining part 113 to form a clamping structure, and an elongate rivet hole 23 formed between the first fastening member 211 and the second fastening member 221.

The drawer 11 further comprises a protective member 30 releasably mounted on a central portion of the handle 20 as detailed below. The protective member 30 includes a first clamping portion 33 on a top rear edge and having a first fastening element 331 extending downward, a second clamping portion 35 on a bottom front edge and having a second fastening element 351 extending upward a covering element 31 on a front surface, a projection 34 on a rear surface directly above the second clamping portion 35, and a recessed label portion 32 on a front surface. The label portion 32 has an area slightly smaller than that of a front surface of the protective member 30. Thus, a label having a graphic, word(s), number (s) or letter(s) can be affixed to the recessed label portion 32 (see FIG. 6). Further, information can be shown on the label. Furthermore, the label enables the cabinet 10 to be easily identified.

The protective member 30 is formed of hard resin material and is non-conductive. Thus, static electricity may not build up on the protective member 30. A person may not be shocked by static discharge when the hand contacts the protective member 30. Thus, the user may have a feeling of comfort.

In an assembled state, the protective member 30 is mounted on the handle 20 by inserting the projection 34 into the complimentary hole 26, by urging the first clamping portion 33 and the first fastening element 331 against the first stop 24, and by urging the second clamping portion 35 and the second fastening element 351 against the second stop 25. Further, the drawer 11 is secured to the handle 20 by driving each of a plurality of rivets 30 through the joining part 113 into the riveting hole 23 to secure the joining part 13, the first fastening portion 21, and the second fastening portion 22 together. As a result, a complete drawer 11 assembled and the assembly is simple and reliable.

While the invention has been described in terms of preferred embodiments, those skilled in the art will recognize that the invention can be practiced with modifications within the spirit and scope of the appended claims.

What is claimed is:

1. A drawer comprising:

two side plates;

a front plate including an upper joining part, the joining part having an elevation greater than that of either side plate;

a rear plate;

a bottom;

a handle secured to the joining part; and a protective member releasably mounted on the handle and including a covering element on a front surface for covering a portion of the handle, wherein the handle includes a first fastening portion on a rear surface and a second fastening portion formed on the rear surface, the second fastening portion being under the first fastening portion to form a clamping structure;

wherein the first fastening portion includes a first fastening member extending downward from an open end, the second fastening portion includes a second fastening member extending upward from an open end, and an elongate rivet hole formed between the first fastening member and the second fastening member;

wherein the handle includes a first stop extending downward from a top rear edge, the first stop urging against a bent top of the joining part, and a second stop formed on a bottom end; and wherein the protective member includes a first clamping portion on a top rear edge and having a first fastening element extending downward, and a second clamping portion on a bottom front edge and having a second fastening element extending upward, and wherein the protective member is mounted on the handle by urging the first clamping portion and the first fastening element against the first stop, and by urging the second clamping portion and the second fastening element against the second stop.

2. The drawer of claim 1, further comprising at least one rivet each driven through the joining part into the riveting hole to secure the joining part, the first fastening portion, and the second fastening portion together.

3. The drawer of claim 1, wherein the handle comprises a hole, and wherein the protective member comprises a projection on a rear surface, the projection being complimentarily disposed in the hole.

* * * * *